US006468349B1

(12) United States Patent
Inaba et al.

(10) Patent No.: US 6,468,349 B1
(45) Date of Patent: Oct. 22, 2002

(54) PLASTIC PRODUCT PAINTING MASK

(75) Inventors: Keiichi Inaba, Shizuoka (JP); Kiyoshi Yazaki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 145 days.

(21) Appl. No.: 09/657,270

(22) Filed: Sep. 7, 2000

(30) Foreign Application Priority Data

Sep. 7, 1999 (JP) ..... 11-252790

(51) Int. Cl.[7] ..... B05C 11/11
(52) U.S. Cl. ..... 118/504; 118/505
(58) Field of Search ..... 118/504, 505; 427/282

(56) References Cited

U.S. PATENT DOCUMENTS 5,468,533 A * 11/1995 Lipson ..... 428/40
5,567,239 A * 10/1996 Ribic, Jr. ..... 118/505
5,833,347 A 11/1998 Nakamura et al. ..... 362/66

* cited by examiner

*Primary Examiner*—Laura Edwards
(74) *Attorney, Agent, or Firm*—Sughrue Mion, PLLC

(57) ABSTRACT

A painting mask, which has an edge portion for defining a painting area parting line, is formed in a mask body which has a predetermined dimension enough to cover a work made from plastic, the mask body including a mask body base portion which is composed of a metal plate with a dimension substantially matching a work, and a painting area circumferential edge portion which is molded integrally with the mask body base portion by curing a thermosetting plastic (epoxy resin) prepared like clay and in which an edge portion for defining a parting line for a painting-presumptive area is formed. The mask body base portion does not shrink during the process where the mask body is manufactured, so that a painting mask with a proper dimension can be obtained.

4 Claims, 6 Drawing Sheets

PLASTIC PRODUCT PAINTING MASK

BACKGROUND OF THE INVENTION

1. Field of the Invention

The present invention relates, to a plastic product painting mask used for applying a painting treatment to a desired portion of a plastic molding such as a lens, a decorative frame, or the like, which is a constituent part of a lighting tool for a vehicle.

2. Description of the Related Art

To apply painting to a plastic product which is part of a lighting tool for a vehicle, a painting mask is disposed on a molding (work), and a predetermined area of the molding is painted with a spray gun or the like, by way of example. Then, in a conventional painting mask, a nickel mask is used in which an edge portion for defining a painting area parting line is formed. Such a conventional mask was generally formed into a predetermined shape corresponding to the external shape of the work by electro-casting.

However, although the above-mentioned conventional painting mask was very high in dimensional accuracy because it was produced by electro-casting, there was a problem in that large-scale manufacturing equipment was required and it took a great deal of time to manufacture.

SUMMARY OF THE INVENTION

The present invention was developed taking into consideration the foregoing problem related to the conventional painting mask. Accordingly, it is an object of the present invention to provide a plastic product painting mask which is easy to manufacture, and which has a predetermined dimensional accuracy with a configuration in which a mask body base portion is formed of a metal plate with a dimension substantially matching the work, and another configuration in which a painting area circumferential edge portion having an edge portion for defining a painting area parting line is formed out of plastic.

In order to achieve the above object, the present invention includes a lighting tool painting mask in which an edge portion for defining a painting area parting line is formed in a mask body of a predetermined-size covering a work made from plastic, wherein the mask body is constituted by a mask body base portion composed of a metal plate with a dimension substantially matching the work, and a painting area circumferential edge portion molded out of plastic integrally with the mask body base portion, the painting area circumferential edge portion having the edge portion for defining a painting area parting line formed therein.

In the plastic product painting mask of the present invention, the work is a constituent part of a lighting tool for a vehicle, and the painting area circumferential edge portion is molded by solidifying the plastic which is prepared like clay.

Although the painting area circumferential edge portion made from plastic can be molded integrally with a predetermined portion of the mask body base portion, the plastic which is prepared like clay is applied to a predetermined portion of the mask body base portion and solidified so that the painting area circumferential edge portion can be molded integrally with the mask body base portion, the mask body base portion being composed of a metal plate which does not shrink in on itself as in the case of a plastic. Accordingly, the mask body as a whole can be formed with an appropriate dimension.

In addition, even if there is a failure in cutting—for example, even if the painting area circumferential edge portion made from plastic is cut excessively—the painting mask can be restored easily by applying the clay-like plastic again.

Further, in the plastic product painting mask of the present invention, a bonding portion between the mask body base portion and the painting area circumferential edge portion is configured in a form where a side edge portion of the mask body base portion is buried in the painting area circumferential edge portion.

The side edge portion of the mask body base portion is surrounded by a plastic layer which constitutes the painting area circumferential edge portion, so that the bonding strength between the mask body base portion and the painting area circumferential edge portion is high.

In addition, in the case where the mask body is used in a painting step, it is difficult to damage the work because the painting area circumferential edge portion in contact with the work is composed of plastic.

In the plastic product painting mask according to the present invention, the plastic prepared. like clay in hardness is molded and solidified along a painting-presumptive area of the work while being pressed on the painting-presumptive area tightly, so that the painting area circumferential edge portion is integrated with the mask body base portion.

If the mask body base portion is disposed on the work and the plastic prepared like clay is molded and solidified along the side edge portion of the mask body base portion while being pressed thereon tightly, other painting area circumferential edge portion can be molded integrally with the side edge of the mask body base portion easily. After that, the edge portion for defining a painting area parting line may. be formed in the painting area circumferential edge portion by cutting.

Still further, in the plastic product painting mask of the present invention, the plastic is composed of epoxy resin into which a curing agent is mixed.

In the present invention, epoxy resin is used as it is easy to be solidified by a curing agent, and low in molding shrinkage. Further, no by-product is produced when epoxy resin is solidified. In addition, epoxy resin has extremely excellent adhesion properties and superior mechanical properties.

BRIEF DESCRIPTION OF THE DRAWINGS

FIG. 5(*b*) is a sectional view thereof.

FIG. 6(*b*) is a sectional view thereof.

DETAILED DESCRIPTION OF THE PREFERRED EMBODIMENTS

The present invention is described as follows, with description being made of some of the preferred embodiments with reference to the drawings.

Figure 1:
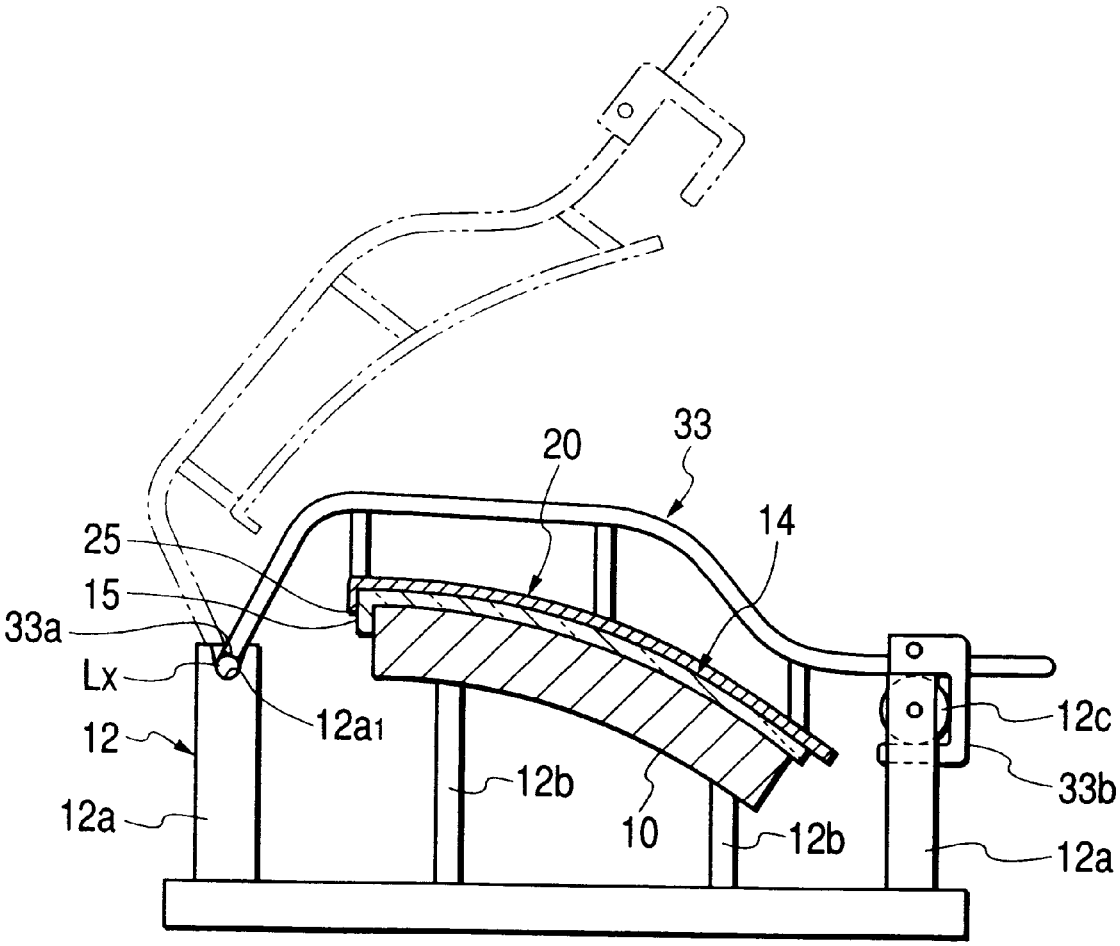
FIG. 1 is a view showing the whole configuration of a painting mask apparatus to which a painting mask according to the present invention is applied.

In FIG. 1, the reference numeral 10 represents a receiving jig for mounting a synthetic, resin decorative frame 14 for a head lamp as a work. The receiving jig 10 is supported on a support bed 12 like a rectangular frame in plan view. A pair of left and right columnar supports 12*a* for holding an upper frame 33 (a mask body 20), which will be described later, are provided vertically in front and rear end portions of the support bed 12 (in left and right end portions in FIG. 1). Four columnar supports 12*b* for supporting the receiving jig 10 are provided vertically in a substantially central portion, in the front/rear direction, of the support bed 12.

The receiving jig 10 is formed into a bent shape corresponding to the internal shape of the decorative frame 14 which is bent into a U-shape in the front view. When the decorative frame 14 is put on the receiving jig 10, the receiving jig 10 is held in the form where a painting-presumptive area 15 (designated by the oblique lines in FIG. 2) of the decorative frame 14 looks toward the front of the apparatus (leftward direction in FIG. 1).

The reference numeral 20 represents a mask body which is a painting mask formed to be large enough to cover the whole of the decorative frame 14 from above. An edge portion 25 for defining a parting line for the painting-presumptive area 15 of the decorative frame 14 is formed in the mask body 20.

In addition, the mask body 20 is integrated with an upper frame 33 which swings around a horizontal pivot shaft Lx provided between the pair of columnar supports 12*a* and 12*a* opposite to each other on the rear end side of the support bed 12. Thus, the mask body 20 can swing integrally with the upper frame 33. That is, the upper frame 33 has a rectangular shape in plan view, and a horizontal pipe 33*a* on one end portion side of the upper frame 33 engages with U-grooves $12a_1$ of the columnar supports 12*a* of the support bed, so that the upper frame 33. (the mask body 20) can swing around the horizontal pivot shaft Lx (see the imaginary lines in FIG. 1). In addition, a hook 33*b* provided on the other end side is hooked on latch portions 12*c*. provided on the support bed 12, so that the upper frame 33 can hold the mask body 20 in a closed state.

Then, as shown by the solid lines in FIG. 1, spray painting is applied to the circumferential edge portion predetermined area (painting-presumptive area) 15 of the decorative frame 14 while the mask body 20 is held in the closed state. Thus, precise painting can be performed.

Figure 2A:
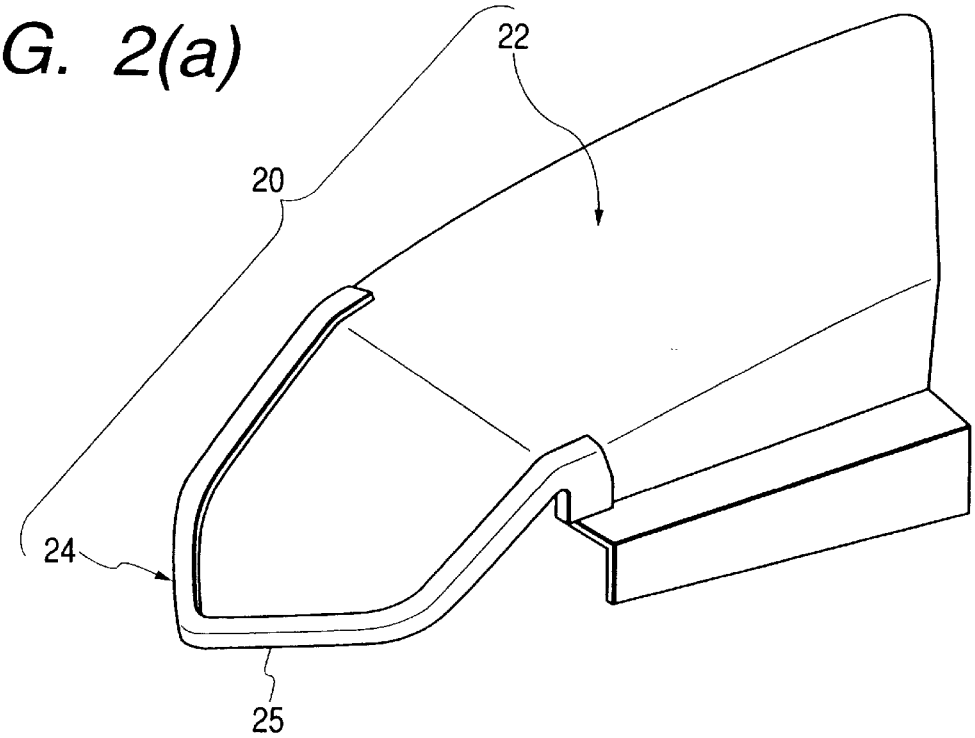
FIGS. 2(*a*) and 2(*b*) show perspective views of the painting mask according to a first embodiment of the invention, with a head lamp decorative frame as a work, FIG. 2(*a*) showing the parts of the mask body, and FIG. 2(*b*) showing the painting presumptive area with the head lamp decorative frame.
Figure 2B:
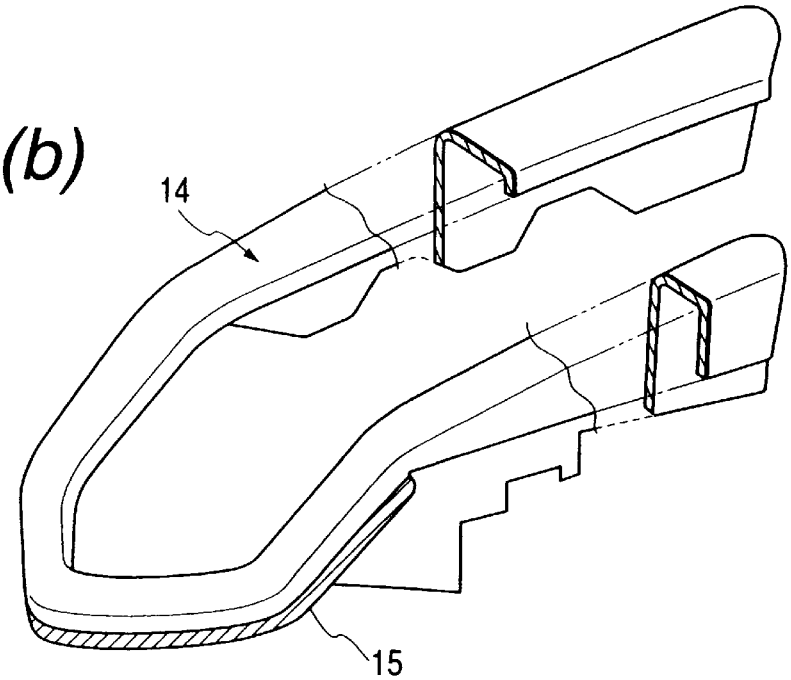
Figure 3:
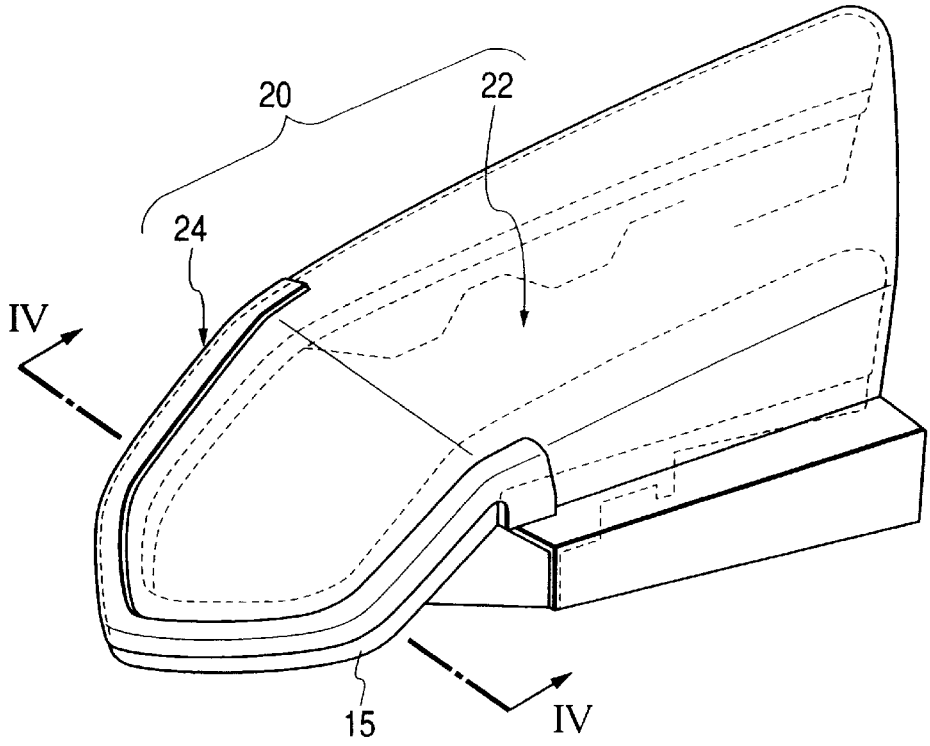
FIG. 3 is a perspective view of the painting mask set on a work.
Figure 4:
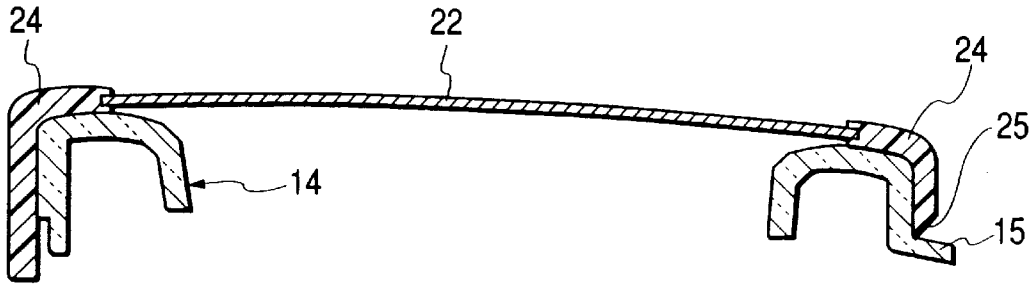
FIG. 4 is a vertical sectional view of the painting mask (sectional view taken on line IV—IV shown in FIG. 3).

In addition, as shown in FIGS. 2(*a*) and 2(*b*), the mask body 20 is constituted by a mask body base portion 22 composed of a tongue-like metal plate having a dimension substantially matching the decorative frame 14, and a painting area circumferential edge portion 24 molded integrally with the mask body base portion 22 and composed of epoxy resin.

An iron plate is cut into a predetermined shape and then bent so that the mask body base portion 22 is formed into a shape as shown in FIG. 2(*a*). A tongue-like area 23 (see FIG. 5) of the mask body base portion 22 is formed to be a little smaller than the external shape of the decorative frame 14 while the painting area circumferential edge portion 24 having an L-shape in section and covering the outer circumference of the decorative frame 14 is molded integrally with the circumferential edge portion of the tongue-like area 23. The edge portion 25 for defining a parting line for the painting-presumptive area 15 of the decorative frame 14 is formed in the painting area circumferential edge portion 24 (see FIGS. 2(*a*) and 2(*b*)).

Next, the process for producing this painting mask body 20 will be described with reference to FIGS. 3 to 7.

First, the mask body base portion 22 composed of an iron plate formed into a predetermined shape and curing-agent-containing epoxy resin adjusted like clay in hardness is prepared.

Figure 5A:
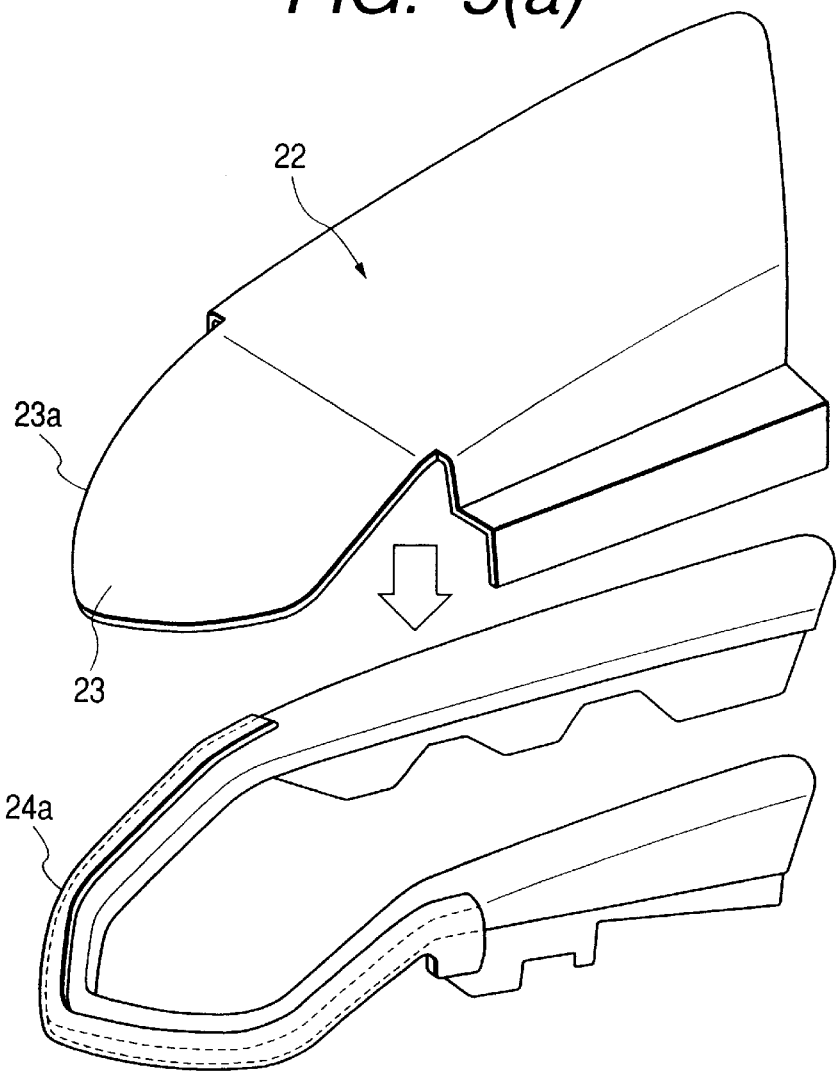
FIGS. 5(*a*) and 5(*b*) show views of a process of manufacturing the painting mask, with FIG. 5(*a*) being a perspective view showing the state where a mask body base portion is put on the decorative frame through clay-like epoxy resin.
Figure 5B:
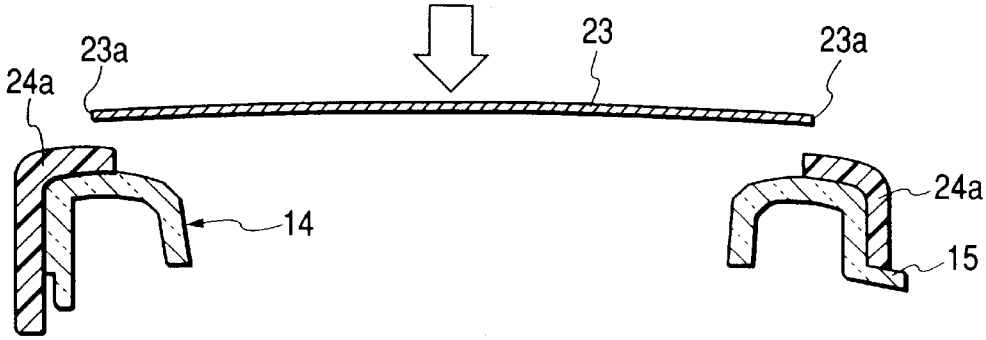

Next, as shown in FIG. 5(*a*), after a release agent is applied to an area along the painting-presumptive area 15 of the decorative frame 14, the clay-like epoxy resin is applied along the painting-presumptive area 15. The reference numeral 24*a* in FIGS. 5(*a*) and 5(*b*) represent an epoxy resin layer applied along the circumferential edge portion of the decorative frame 14.

Next, as shown by the arrows in FIGS. 5(*a*) and (*b*), the mask body base portion 22 is put on the decorative frame 14.

Figure 6A:
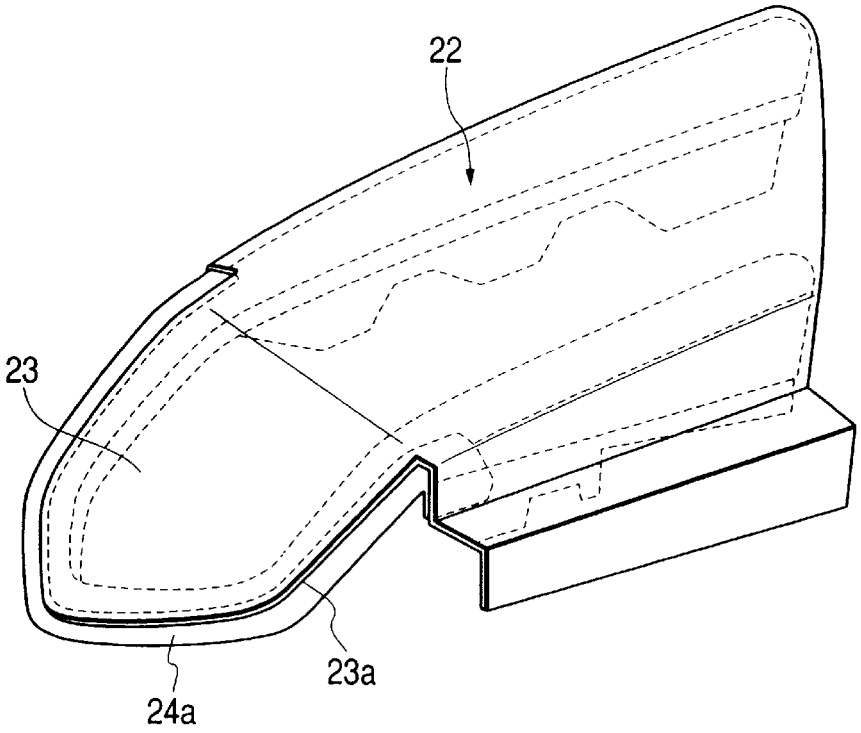
FIGS. 6(*a*) and 6(*b*) show views of the process of manufacturing the painting mask, with FIG. 6(*a*) being a perspective view showing the state where the clay-like epoxy resin is further applied onto a circumferential edge portion of the mask body base portion put on the decorative frame.
Figure 6B:
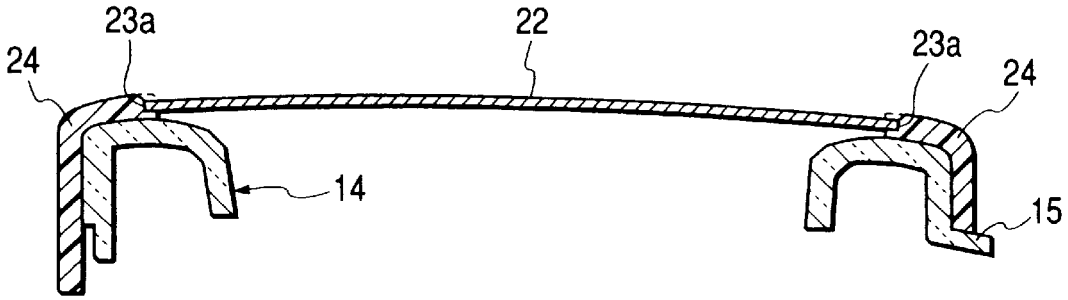

As shown in FIGS. 6(*a*) and (*b*), the clay-like epoxy resin is further applied so that a circumferential edge portion 23*a* of the tongue-like area 23 of the mask body base portion 22 is placed between epoxy resin layers (see the imaginary lines in FIG. 6(*b*)). Then, when the mask body base portion 22 is left as it is for a while (for about half a day), the epoxy resin is hardened so that the original form 20' (see FIG. 7) of the mask body 20 in which the painting area circumferential edge portion 24 made of epoxy resin is molded integrally with the mask body base portion 22, is completed.

Figure 7:
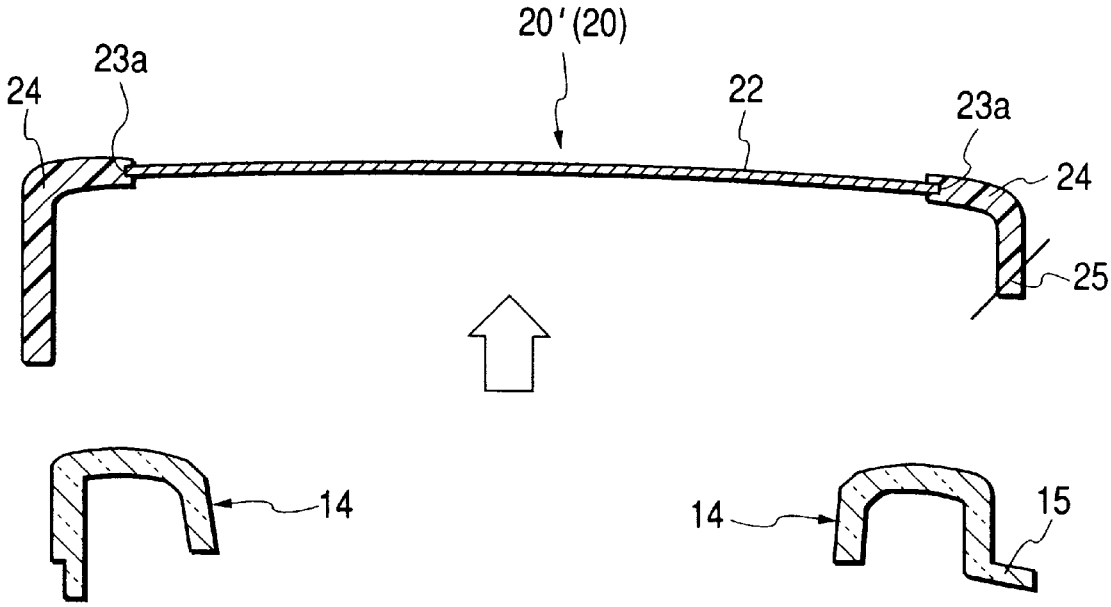
FIG. 7 is a sectional view showing the state where a painting mask body molded on the decorative frame is separated from the decorative frame.

After that, as shown in FIG. 7, this original form 20' of the mask body 20 is separated from the decorative frame 14, and the edge portion 25 for defining a parting line for the painting-presumptive area 15 is formed in the painting area circumferential edge portion 24 by cutting.

Incidentally, if the whole of the mask body 20 from the mask body base portion 22 to the circumferential edge portion 24 is constituted by a plastic molding, the mask body base portion 22 shrinks on curing when it is molded. The shrinkage may cause a reduction in the dimensional accuracy of the mask body 20. In this embodiment, however, since the mask body base portion 22 of the mask body 20 is formed of an iron plate, there is no fear that the mask body base portion 22 shrinks so that the dimensional accuracy deteriorates when the mask body 20 is manufactured. Accordingly, the mask body 20 is formed with a predetermined dimensional accuracy.

Incidentally, although the painting area circumferential edge portion 24 was composed of epoxy resin in the above-mentioned embodiment, the material is not limited to epoxy resin, but the painting area circumferential edge portion 24 may be composed of a general thermosetting plastic such as polyurethane, polyester resin or the like, or ultraviolet-curing plastic.

As is apparent from the above description, in a painting mask according to the present invention, a mask body base portion is composed of a metal plate. Accordingly, a painting mask with an appropriate dimension can be obtained.

In addition, by machining the molded painting area circumferential edge portion, an edge portion for defining a painting area parting line can be formed easily in the painting area circumferential edge portion.

In addition, even if machining is unsuccessful, the painting area circumferential edge portion can be restored easily. Accordingly, it becomes easy to form the edge portion for defining a painting area parting line.

Moreover, in comparison with a conventional painting mask produced by electrocasting, the formation of the mask can be performed easily in a short time without the requirement of any large-scale manufacturing equipment.

Further, the bonding strength between the mask body base portion and the painting area circumferential edge portion is so high that the mask can be used long term and there is no apprehension that the work is damaged.

Further, since the mask body hardly shrinks on curing when the painting area circumferential edge portion is molded, it is possible to mold the painting area circumferential edge portion with a proper edge portion for defining a parting line.

In addition, the mechanical strength in the painting area circumferential edge portion, and the bonding strength between the mask body base portion and the painting area circumferential edge portion are so high that the painting mask is high in durability as much and can be used long term.

It is contemplated that numerous modifications may be made to the apparatus and procedure of the invention without departing from the spirit and scope of the invention as defined in the following claims.

What is claimed is:

1. A painting mask, said painting mask being of a predetermined size to cover a work made from plastic, said painting mask comprising:

a mask body including an edge portion for defining a painting area parting line formed in said mask body, said mask body comprising:

a mask body base portion composed of a metal plate with a dimensional size substantially matching said work; and a painting area circumferential edge portion molded out of plastic integrally formed with said mask body base portion, said painting area circumferential edge portion having said edge portion for defining the painting area parting line formed therein.

2. A painting mask according to claim 1, wherein said work is a part of a lighting tool for a vehicle.

3. A painting mask according to claim 1, further comprising a bonding portion disposed between said mask body base portion and said painting area circumferential edge portion, said bonding portion being configured in a form wherein a side edge portion of said mask body base portion is buried in said painting area circumferential edge portion.

4. A painting mask according to claim 1, wherein the plastic is an epoxy resin.

* * * * *